United States Patent [19]

Willey et al.

[11] Patent Number: 4,919,785

[45] Date of Patent: Apr. 24, 1990

[54] MICROWAVE CARTON

[75] Inventors: Monroe J. Willey, East Brunswick; Daniel D. Evert, Englishtown, both of N.J.

[73] Assignee: Kraft General Foods, Inc., Glenview, Ill.

[21] Appl. No.: 192,262

[22] Filed: Apr. 28, 1988

[51] Int. Cl.[5] ..... B65D 5/24; B65D 5/40; B65D 5/54

[52] U.S. Cl. ..... 206/625; 229/188

[58] Field of Search ..... 229/903, 188; 206/612, 206/625, 608, 609, 611

[56] References Cited

U.S. PATENT DOCUMENTS

| | | | |
|---|---|---|---|
| 2,973,086 | 2/1961 | Thompson | 206/607 |
| 3,004,697 | 10/1961 | Stone | 206/611 |
| 3,246,829 | 4/1966 | Sexton | 229/188 |
| 3,301,391 | 1/1967 | Guyer | 206/622 |
| 4,043,503 | 8/1977 | Meyers et al. | 206/625 |
| 4,449,633 | 5/1984 | Johnson et al. | 206/612 |
| 4,550,834 | 11/1985 | Fletcher et al. | 206/611 |
| 4,584,202 | 4/1986 | Roccaforte | 206/608 |

*Primary Examiner*—Stephen P. Garbe

*Attorney, Agent, or Firm*—Thomas R. Savoie; Daniel J. Donovan

[57] ABSTRACT

A carton of unitary structure which is adapted for heating food, especially frozen food, in a microwave oven. An openable removable top flap for the carton is formed by partially scoring the outer and inner surfaces of the top panel and providing slit lines or foraminating the front flap. The slit lines of foraminations in the front flap, preferably herringbone slit lines formed into the surface of the carton, extend from locations at a top flap crease in the top panel to positions adjacent a lifting tab portion provided at the free edge of the front flap. A pair of spaced apart first and second score lines are formed in the upper surface of the top panel along the crease line forming the folding edges of the side flaps and along the back flap, whereas a pair of third and fourth score lines in the lower surface are closely spaced apart from and in parallel with but wider spread apart than the first and second score lines.

6 Claims, 4 Drawing Sheets

MICROWAVE CARTON

BACKGROUND OF THE INVENTION

1. Field of the Invention

The present invention relates in general to cartons, and more particularly, relates to a carton of unitary structure which is adapted for heating food, especially frozen food, in a microwave oven.

In recent years, microwave ovens have assumed an important position in the kitchens of numerous homeowners, inasmuch as they enable foods, various kinds of foods, such as frozen food consisting of vegetables and even complete meals to be quickly and conveniently heated and/or cooked in microwave ovens.

In particular, modern homemakers who frequently prepare meals for a household while concurrently being employed in a full-time job in industry or commerce, have recognized the convenience of microwave cooking and heating of frozen foods and the like. However, in order to do so, some labor-intensive steps must be undertaken. In essence, the food must be removed from the package, irrespective as to whether it is constituted of a plastic or paperboard carton or a foil tray, arranged in a dish transparent to microwaves and possessing the necessary strength and then heated in the microwave oven. This step is necessary since various objects, such as aluminum foil trays or other metal receptacles containing the food cannot be employed in microwave ovens; whereas other types of cartons are not suitable for the retention of liquids. On the other hand, cartons which are designed to hold liquids, utilize adhesives, which when subjected to the heat of the microwave oven frequently produce off-tastes and generate off-odors in the foods.

2. Discussion of the Prior Art

In order to improve upon the structure and the convenience in the utilization of microwave cartons, particularly cartons which can be opened prior to and/or during the cooking sequence to enable access to the carton contents, and then reclosed so as to effectively seal in the food, various types of microwave cartons have been developed in the art.

Thus, Ielmini U.S. Pat. No. 4,687,104 discloses a microwave carton possessing a top and front flap structure parallel spaced inner and outer score lines to define operable and recloseable top and front flap portions through the formation of tearable joints. The top flap portion is configured to allow for the retention of a full-strength U-shaped top surface to enable lifting of the carton and contents therein without affecting the intergrity of the carton structure. This type of carton, while enabling the heating of foods in a microwave oven, does not enable the sealing reclosure of the front flap portion because of the incorporation of the parallel spaced tear joint lines, and moreover, in one embodiment, includes a tab-receiving slit in the sidewall thereof which will permit liquids to escape from the carton during the heating of the carton contents in a microwave oven.

Meroszek U.S. Pat. No. 4,594,492 pertains to a microwave package in the nature of a carton which incorporates structure for browning foods in the carton when cooked in a microwave oven. There is no disclosure of a carton which allows for the resealing thereof prior to or after heating the carton contents in the oven so as to inhibit the egress of any liquids from the carton.

Smith U.S. Pat. No. 3,167,238 discloses a recloseable carton which incorporates top and front flap portions which are openable by separation from the remaining carton along tear lines and formations. The carton may then be reclosed by tucking in of the separated front flap portion behind a front carton panel. Although this carton is basically recloseable, it is of an adhesively-sealed configuration which is not readily adapted for use in the heating or cooking of foods therein in a microwave oven.

SUMMARY OF THE INVENTION

Accordingly, the present invention contemplates the provision of a carton which is adapted for the heating and cooking of foods directly in the carton in a microwave oven in the absence of any leaking, producing off-tastes or generating off-odors in the foods which would be unpalatable to a consumer.

The carton is constituted from a unitary carton blank material incorporating a bottom carton portion and a top carton portion. The carton bottom portion has a generally rectangular bottom panel, and with side panels extending from the periphery of the bottom panel and with web corners provided between adjacent side panels. The side panels and web corners are folded upwardly, preferably along creases or fold lines which are formed in the carton material, such as to produce a food or product-receiving carton bottom structure. The side panels and web corners are preferably folded, heated and sealed then filled with product. Optionally, the side panels and web corners may be temporarily maintained in this folded condition while the carton bottom structure is being filled with product through the provision of suitable cooperating tabs and notches formed in the side panels and web corners; for instance, such as has been developed by the Kliklok Corporation, Greenwich, Connecticut.

The top carton portion includes a rectangular top which is adapted to cover the rectangular bottom panel, and extends from and is hingedly connected with an outer edge of one of the side panels. The top carton portion includes side flaps extending from opposite edges of the periphery of the top panel at both sides of the hinged edge thereof with the bottom side panel, and a front flap. After filling the carton bottom structure with the food product which is to be cooked or heated, the top panel is folded down over the carton bottom structure and the flaps are folded over and contacted against the surfaces of adjacent sides panels. One of the contacting surfaces of the carton material is coated with a waterproof, heat sealable coating so as to facilitates the flaps to be heat-sealed to the side panels in a manner well known in the carton heat sealing technology.

An openable, removable top flap for the carton is formed by partially scoring the outer and inner surfaces of the top panel and providing slit lines or foraminations in the front flap. The slit lines or foraminations in the front flap, preferably herringbone slit lines formed into the surface of the carton, extend from locations at a top flap crease in the top panel to positions adjacent a lifting tab portion provided at the free edge of the front flap. A pair of spaced apart lower score lines are formed in the inner surface of the top panel of the carton, whereas a pair of spaced apart upper score lines in the outer surface are closely spaced apart from and in parallel with but wider spread apart than the lower score lines. The score lines extend along the top panel, with the first and second upper score lines extending along the creases forming the folding or folded edges of the side flaps then being angled towards each other as they approache the rear side panel connecting the top panel to the bottom panel then along the crease forming the folding edge of the top panel and the rear side panel, where the first and second upper score lines connect, said score lines extending along the folding edges in a non-continuous fashion in the form of perforated cut scores, and generally parallel to and spaced apart from the lower score lines over a major portion of the top panel, and then being angled towards each other towards the front flaps until the outside surface or upper score lines meet the foraminations in the front panel and wherein said score lines which angle away from and extend between the folded edges are continuous, said parallel score lines providing a frangible tear path so that upon lifting of the lifting tab, the front flap and top tear in the region between the foraminations and the score lines facilitating the top flap to be lifted up away from the carton top panel and exposing the contents of the carton to view or removed entirely to provide easy access.

A primary advantage of the invention resides in that a user can readily heat and/or cook the food product in the microwave while the food remains in the carton. The user is afforded convenient and fully access to the entire contents of the carton, by merely lifting the top flap, without destroying or adversely affecting the structural integrity of the carton. Although the top flap overlies or covers a substantial portion of the carton bottom structure lifting or removing the top flap by separation of the score lines and foraminations does not substantially impair the structural integrity of the carton, and allows it to be easily reclosed. When the entire top flap is removed, the triangular corners which remain provide additional structural support for the carton.

The employment of "herringbone" foraminations or slit lines in the separating lines for the detachable portion of the front flap, allows the latter to be readily tucked in behind the side portions of the remaining front flap upon reclosing the carton. This forms a secure latching and sealing action preventing an inadvertent opening of the reclosed carton during continued heating in the microwave oven and during subsequent handling prior to its intended reopening for dispensing the heated food contained therein.

Accordingly, it is a primary object of the present invention to provide a novel microwave carton facilitating the heating of a food product contained therein in a microwave oven.

Another object of the invention resides in the provision of a carton as described herein incorporating a flap structure which allows for the ready and simple reclosing of the carton subsequent to opening thereof to gain access to the carton contents.

BRIEF DESCRIPTION OF THE DRAWINGS

Reference may now be had to the following detailed description of a preferred embodiment of the inventive microwave carton showing the advantageous and novel features thereof, taken in conjunction with the accompanying drawings; in which.

DETAILED DESCRIPTION

Figure 1:
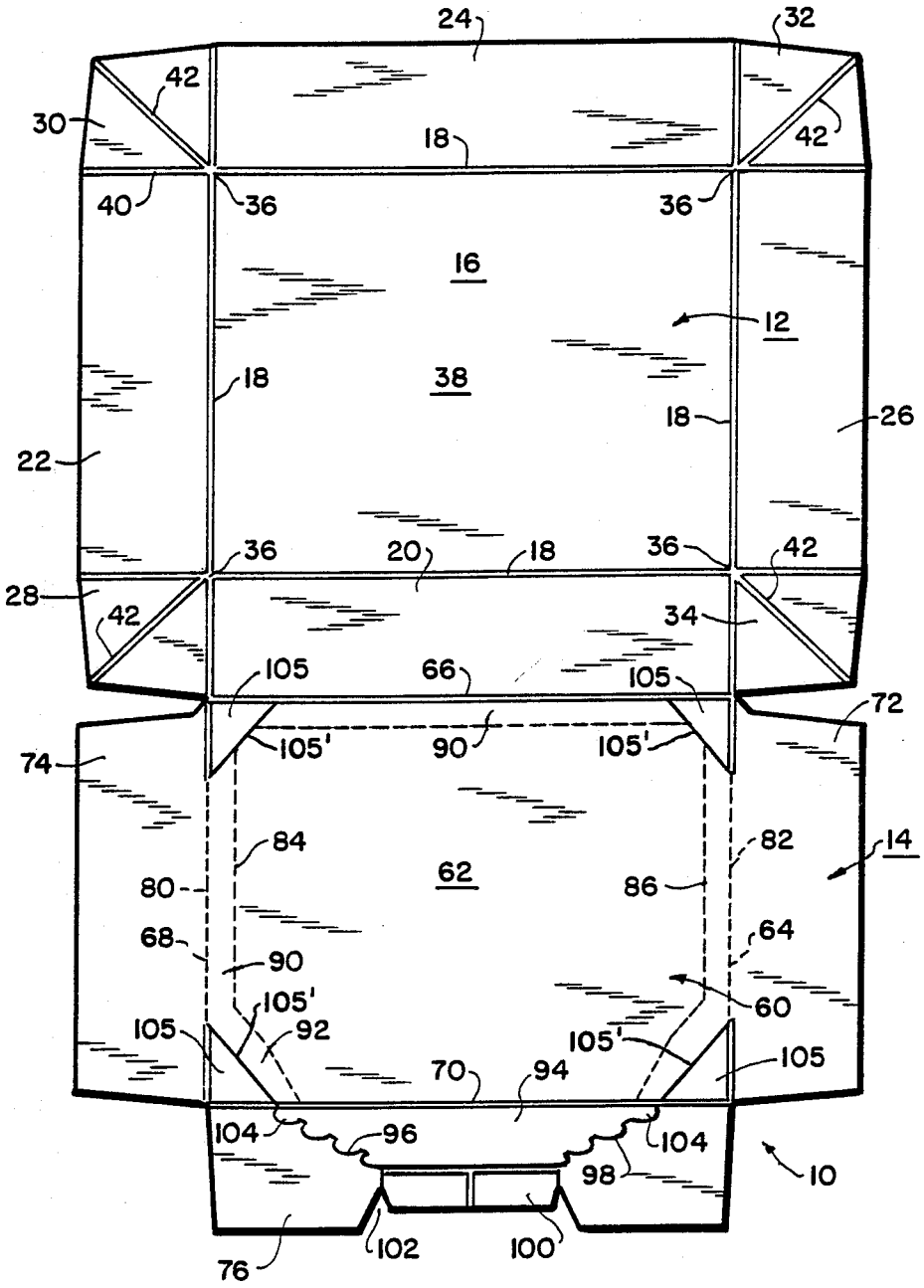
FIG. 1 illustrates a flat carton blank for producing the microwave carton pursuant to the invention.
Figure 2:
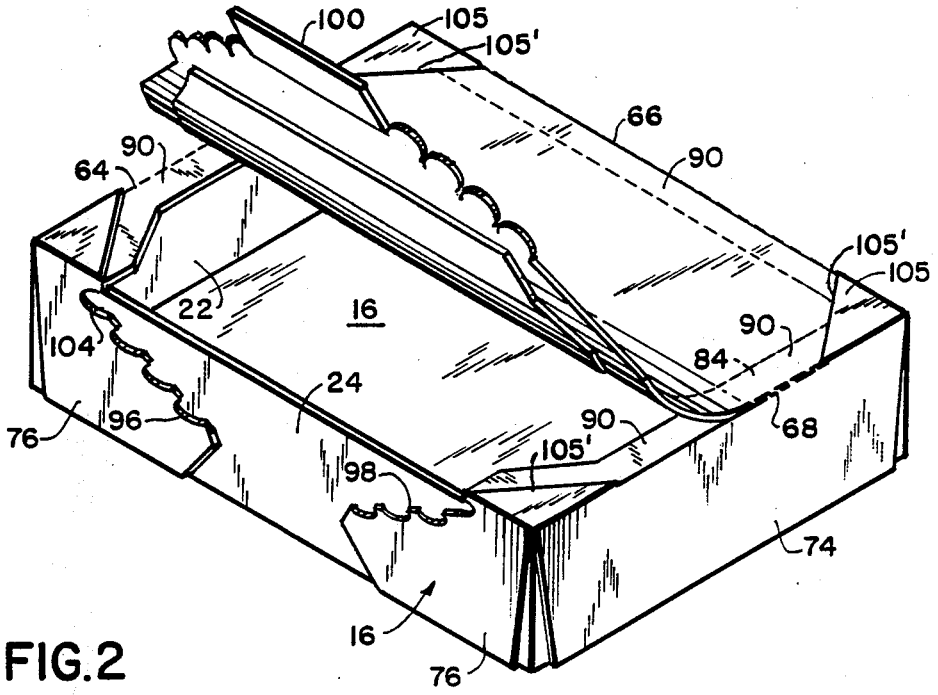
FIG. 2 illustrates a perspective view of the assembled microwave carton in a partially opened condition showing the exposed carton contents.
Figure 3:
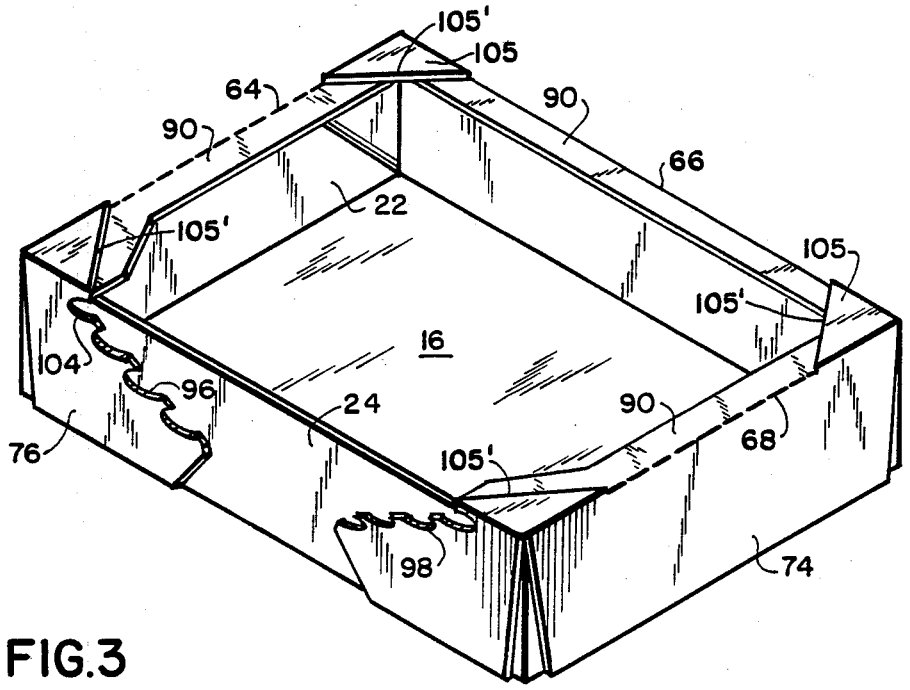
FIG. 3 illustrates, a perspective view of the assembled microwave carton with the top portion completely removed.

Referring to FIGS. 1 to 3, carton 10 inludes, in general, a carton bottom structure 12 and a carton top structure 14 which, when assembled, is used to contain a product, for instance, a food such as a frozen vegetable, dinner, etc., in the carton for direct heating and cooking within the carton in a microwave oven (not shown).

The bottom structure 12 includes a rectangular bottom panel 16 defined by periphery 18. Side panels 20, 22, 24, 26 extends from respectively each side of periphery 18, while web corners 28, 30, 32, 34 extend between the respective adjacent side panels at the corners 36 of bottom panel 16. Crease lines are formed at the intersections of bottom panel 16 and side panels 20 to 26 along the periphery 18 and at the intersections 40 of its web corners with the sides so as to bend inwardly from the outer surface 38 of carton 10. A diagonal crease 42 is formed in each of the web corners from the corners 36 of bottom panel 16 so as to assist in the folding in thereof during the formation of the assembled carton, as shown in FIG. 2.

The bottom portion or structure of the carton is maintained in the form of a box-like, food containing configuration by the use of heat sealing during filling of carton 10 as shown in FIGS. 2 and 3.

Figure 5:
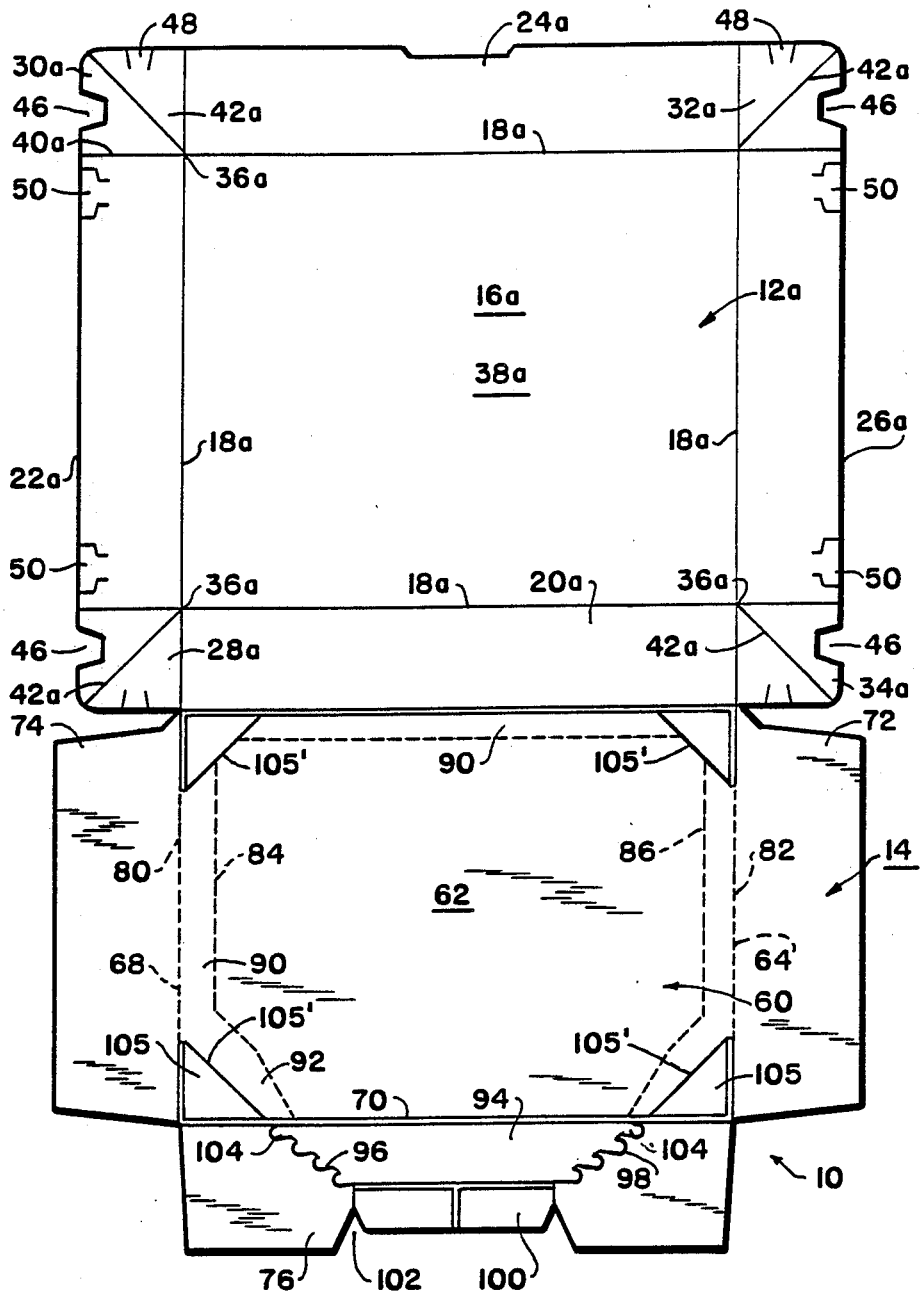

In FIG. 5 the side panels and web corners are temporarily maintained in a folded condition while the carton bottom structure is being filled with product through the provision of suitable cooperation tabs and notches formed in the side panel of the web corners. Each web corner **28*a*–34*a* include a notch 46 and a notch flap 48 formed along the outer periphery of the web corners. A T-shaped tab 50 is formed along the outer edge of side panels 20*a*–26*a* adjacent notch 46. Notch 46, notch flap 48, and tab 50, which constitute tab and notch fasteners are used to temporarly keep the base portion 16*a*** folded in a food containing configuration.

The top carton structure 60 includes a rectangular top panel 62 having peripheral edges 64, 66, 68 and 70, respectively. A front flap 76 extends from the edge 70, all of the edges 64 to 70 being creased to facilitate the folding thereof. The top panel 62 includes first and second (upper) score lines 80, 82 extending partially through the outer surface and third and fourth (lower) score line 84, 86 extending partially through the inner surface thereof. The score lines extend along the top panel with the first 80 and second 82 upper score lines extending along the crease forming the folding edges of the side flaps 72 and 74 then being angled towards each other along upper score lines 105' as they approach the rear side panel 20 which connects the top panel 62 and bottom panel 16, then along crease 66 forming the folding edge of the top panel where first and second score lines 80 and 82 connect. First and second score lines 80 and 82 extend along the folding edges in a non-continuous fashion in the form of perforated cut scores and generally parallel to and spaced apart from the third and fourth lower score lines 84 and 86 over a major portion of the top panel. As the score lines approach the front flap, the score lines are angled towards each other towards the front flap along upper score lines 105' until the upper score lines 80 and 82 meet the foraminations 96 and 98 in front flap 76. The score lines 105' which angle away from and extend between the folded edges are generally continuous. The first and third score lines 80, 84 and the second and fourth score lines 82, 86 are in parallel with each other and offset by a spacing to form a tear distance 90, thereby defining an openable removable top flap 92. The utilization of perforated cut scores which only partially score the outer and inner surfaces of the top panel, prevents delamination along the edges where the carton is folded.

Figure 4:
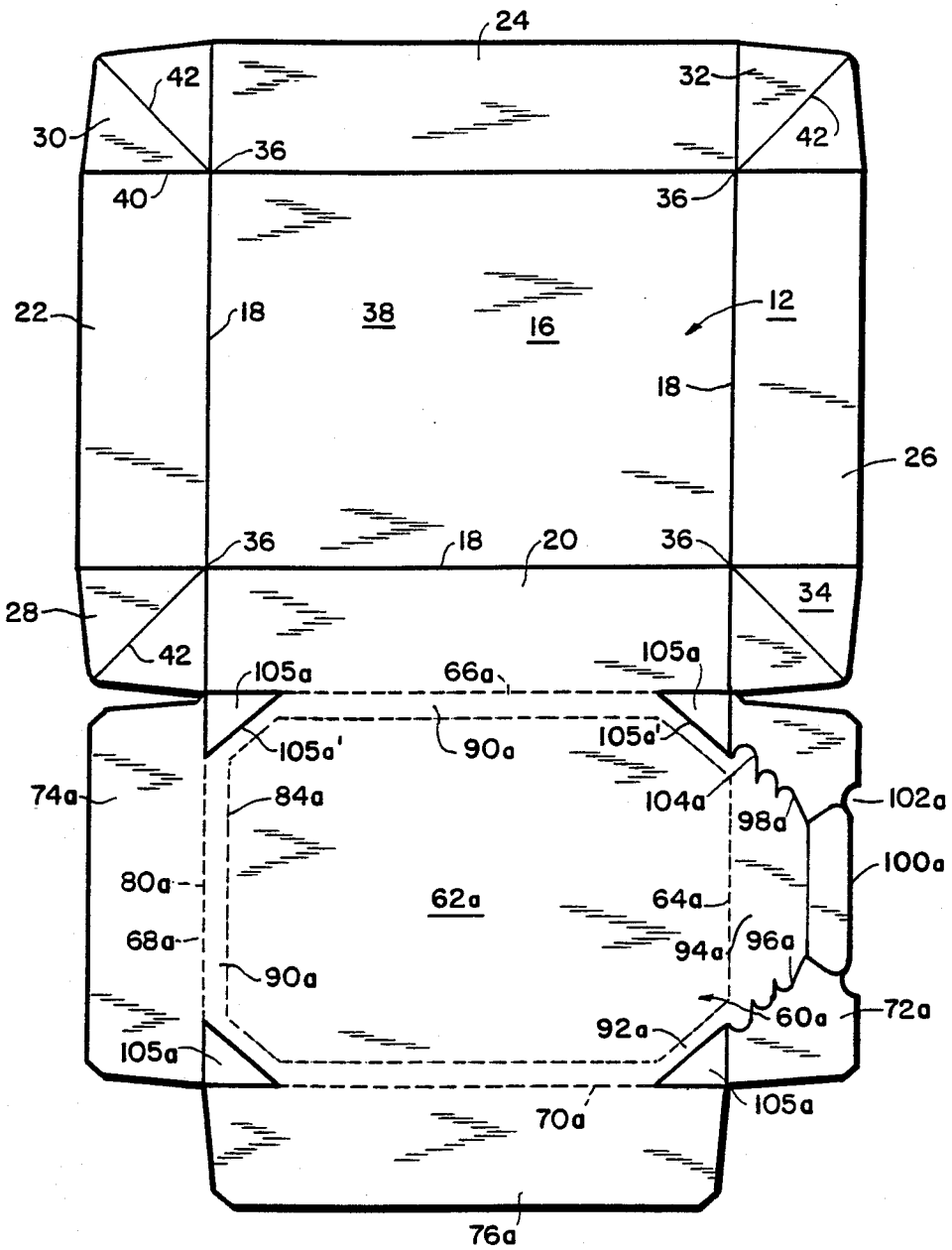
FIG. 4 illustrates a flat carton blank for producing the microwave carton showing access from the side of the carton; and, FIG. 5 illustrates a flat carton blank showing the base of the carton at the corners with tab and notch fasteners for the initial filling of the carton with product.

In another embodiment of the present invention, as shown in FIG. 4, the top carton structure 60*a* includes a rectangular top panel 62*a* having peripheral edges 64*a* through 70*a* respectively, a front flap 72*a* extends from edge, a rear flap 74*a* extends from edge 68*a* and a side flap 76*a* extends from edge 70*a* all of the edges 64*a* to 70*a* being creased to facilitate folding thereof. The top panel 62*a* includes a first and second upper score lines 80*a* and 82*a* extending partially through the outer surface and a third and fourth (lower) score lines, 84*a* and 86*a* extending partially through the inner surface. The score lines extend along top panel with the first 80*a* and the second 82 upper score lines extending along creases 66*a* and 70*a* forming the folding edges of the side flap 76*a* and side panel 20 which connects the top panel 62*a* and bottom or opposite panel 16, then being angled towards each other along upper score lines 105*a* as they approach the side flap 74*a*, then along crease 68*a* forming the folding edge of said side flap 74*a* where the first and second score lines connect. First and second score lines 80*a* and 82*a* extend along the folding edges in a non-continuous fashion in the form of perforated cut score and generally parallel to and spaced apart from the third and fourth lower score lines 84*a* and 86*a* over a major portion of the top panel. As the score lines approach the front flap 72*a*, the score lines are angled towards each other towards the front flap along upper score line 105*a* until the upper score lines 80*a* and 82*a* meet the foraminations 96*a* and 98*a* in front flap 72*a*. The score lines 105*a'* which angle away from and extend between the folded edges are generally continuous. The first and third score lines 80*a* and 84*a*, and the second and fourth score lines 82*a*, 86*a* are in parallel with each other and off-set by a spacing to form a tear distance 90*a*, thereby defining an openable removable top panel 62*a*. In this embodiment the front flap is hingedly connected with the top panel along edge 64*a* and not 70*a*.

An additional feature of the present invention is the ability to remove substantially the entire top panel of the carton thereby allowing complete access to the contents therein. This is accomplished by the first and second upper score lines 80 and 82 the third and fourth lower score lines 84 and 86 running parallel to each other and extending along folding edges 64, 66 and 68 and being angled towards side panel 20 and the front flap 76. This extends the tear distance along the sides of the top panel and across the third rear side opposite the front flap, leaving triangular segments remaining at each corner segment of the carton as shown in FIGS. 2 and 3. The triangular segments 105 remaining after substantially the entire top panel is removed is designed to provide additional structural support to the carton.

A center flap portion 94 of the front flap 76 is hingedly connected with the top panel along edge or 70 (64*a* in the FIG. 5 embodiment) and includes a pair of diverging slit lines or "herringbone" foraminations 96, 98 extending from a lifting tab 100 formed at the free edge of front flap portion 94 between slit lines 96, 98 towards the respective tear distances 90 between the score lines 80, 84 and 82, 86 so as to join therewith. Thus, separation along lines 96, 98 and then along the tear distances 90 will provide access to the carton contents. Cutouts 102 may be formed on both sides of the tab 100 to facilitate gripping of the latter by a user during opening of the carton.

Upon reclosing of the carton 10, the lifting tab 100 is inserted between the side portions of the front flap which are still attached so as to cause the "herringbone" foraminations 96, 98, and particularly the curved portions 104, to latchingly engage therewith and to maintain the top flap 92 in a sealingly carton-closing condition.

In order to form the microwave carton 10, the carton blank shown in FIG. 1 is folded, for instance, by an automatic folding machine. The side panels 20 to 26 and web corners 28 to 34 are folded up from outer surface of carton bottom panel 16. When the side panels are generally perpendicular to the inner surface of the bottom panel 16, the side panels and web corners are heat sealed, as shown in FIG. 3, to maintain the bottom container structure 12 in its folded, box-like product containing configuration. Food product is then filled into the bottom structure 12 and the top structure 60 is folded over until the top panel 62 is located generally in parallel with bottom structure 16. Side flaps 72, 74 and front flap 76 are folded over until they lie in contact with the adjoining side panels. Inasmuch as the external surface of the carton is covered with a water-repellant, heat-sealable coating, the side flaps 72, 74 and portions of the front flap 76 outside of the center flap portion 94 are sealed to the side panels by the application of heat.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A microwave carton which is constructed from a unitary carton blank, said carton comprising:

a carton bottom structure including a substantially rectangular bottom panel, side panels extending from the periphery of said bottom panel and web corners extending between the side panels, crease lines formed along the periphery of said bottom panel, at the intersection of the web corners with the sides and centrally along the web corners to enable folding of the side panels normally of the bottom panel so as to provide a liquid-containing carton bottom structure;

a substantially rectangular carton top structure including a top panel which is integrally connected along a first edge with an outer edge of one of said side panels and being dimensioned to overlie the bottom structure;

a front flap extending from a second edge of said top panel opposite said first edge;

side flaps foldably connected to side edges of said top panel along crease lines located between said first and second edges;

tearable joints extending along said top panel, with first and second upper score lines extending along the crease lines which foldably connect the side flaps to the top panel, then being angled towards each other as they approach the side panel which connects the top panel to the bottom panel, then along a crease which foldably connects said top panel to the side panel which connects the top panel to the bottom panel where the first and second upper score lines connect, said upper score lines extending along said foldable connections in a non-continuous fashion in the form of perforated cut scores and generally parallel to and spaced apart from third and fourth lower cut score lines over a major portion of the top panel, said upper and lower score lines also being angled towards each other towards said front flap, said upper score lines meeting foraminations in the front flap, and wherein said angled score lines are continuous, said spacing apart of the upper and lower score lines forming a tearing distance therebetween over a portion of said top panel; and wherein, the front flap, which is integral with and hinged to the second edge of said top panel, includes a lifting tab, which is formed centrally at the free edge of said front flap, and includes said foraminations which extend between said lifting tab and said tearable joints in said top panel.

2. A carton as claimed in claim 1, wherein said foraminations comprise herringbone-shaped slit lines in said front flap.

3. A carton as claimed in claim 1, wherein a surface of the carton includes a water-repellant coating for withstanding the temperatures encountered during microwave cooking.

4. A carton as claimed in claim 1, wherein the top panel is substantially totally removable.

5. A microwave carton which is constructed from a unitary carton blank, said carton comprising, a carton bottom structure including a substantially rectangular bottom panel, side panels extending from the periphery of said bottom panel and web corners extending between the side panels, crease lines formed along the periphery of said bottom panel, at the intersection of the web corners with the sides and centrally along the web corners to enable folding of the side panels normally of the bottom panel so as to provide a liquid-containing carton bottom structure;

a substantially rectangular carton top structure including a top panel which is integrally connected along a first edge with an outer edge of one of said side panels and being dimensioned to overlie the bottom structure;

a front flap extending from a second edge of said top panel adjacent said first edge;

a side flap foldably connected to the top panel along a crease line adjacent the front flap, and a rear flap foldably connected to the top panel along a crease line opposite the front flap;

tearable joints extending along said top panel, with first and second upper score lines extending, respectively, along the crease line which foldably connects the outer edge of said one of said side panels to the top panel, and the crease line which foldably connects the side flap to the top panel, then being angled towards each other as they approach the rear flap, then along the crease line which foldably connects said rear flap where the first and second upper score lines connect, said upper score lines extending along said crease lines in a non-continuous fashion in the form of perforated cut scores, and generally parallel to and spaced apart from third and fourth lower cut score lines over a major portion of the top panel, said upper and lower score lines also being angled towards each other towards said front flap, said upper score lines meeting foraminations in the front flap, and wherein said angled score lines are continuous, said spacing apart of the upper and lower score lines forming a tearing distance therebetween over a portion of said top panel; and wherein, the front flap, which is integral with and hinged to the second edge of said top panel, includes a lifting tab, which is formed centrally at the free edge of said front flap, and includes said foraminations which extend between said lifting tab and said tearable joints in said top panel.

6. A carton as claimed in claim 5, wherein said foraminations comprises herringbone-shaped slit lines in said front flap.

* * * * *